US009845795B2

(12) United States Patent
Manley et al.

(10) Patent No.: US 9,845,795 B2
(45) Date of Patent: Dec. 19, 2017

(54) DAMPENING APPARATUS

(71) Applicants: Justin P. Manley, Murphy, TX (US); William Garfield, Macungie, PA (US)

(72) Inventors: Justin P. Manley, Murphy, TX (US); William Garfield, Macungie, PA (US)

( * ) Notice: Subject to any disclaimer, the term of this patent is extended or adjusted under 35 U.S.C. 154(b) by 0 days.

(21) Appl. No.: 14/846,872

(22) Filed: Sep. 7, 2015

(65) Prior Publication Data

US 2017/0067456 A1 Mar. 9, 2017

(51) Int. Cl.

| | |
|---|---|
| ***F16L 55/04*** | (2006.01) |
| ***F04B 11/00*** | (2006.01) |
| ***F04B 39/00*** | (2006.01) |
| ***F04B 45/04*** | (2006.01) |
| ***F04B 43/02*** | (2006.01) |

(52) U.S. Cl.

CPC ..... *F04B 11/0008* (2013.01); *F04B 39/0027* (2013.01); *F04B 43/02* (2013.01); *F04B 45/04* (2013.01)

(58) Field of Classification Search

USPC ..... 138/26, 30

See application file for complete search history.

(56) References Cited

U.S. PATENT DOCUMENTS 2,290,337 A * 7/1942 Knauth ..... F16L 55/04 138/30
2,497,020 A * 2/1950 Singer ..... F16L 55/04 138/26
2,701,583 A * 2/1955 Rux ..... F15B 21/008 138/26
2,963,044 A * 12/1960 Hellund ..... F16L 55/04 138/30
3,035,613 A * 5/1962 Beatty ..... F16L 55/052 138/30
3,893,485 A * 7/1975 Loukonen ..... F16L 55/053 138/30
4,032,265 A * 6/1977 Miller ..... F04B 11/0016 137/565.34
4,442,866 A * 4/1984 Loukonen ..... F16L 55/053 138/104
6,651,698 B1 * 11/2003 Wilkes ..... F16K 47/023 138/26
2002/0117223 A1 * 8/2002 Henry ..... F16L 55/053 138/30
2003/0226607 A1 * 12/2003 Young ..... F16L 55/053 138/30
2010/0050622 A1 * 3/2010 Stroganov ..... F15B 1/04 60/413

(Continued)

*Primary Examiner* — James Hook

(74) *Attorney, Agent, or Firm* — Wilson Daniel Swayze, Jr.

(57) ABSTRACT

A dampening apparatus includes a cylindrical container, and one or multiple compression devices positioned within the cylindrical container. The cylindrical container comprises multiple perforations on circumferential walls, and has an opening at one end. Each compression device comprises multiple compression cavities configured to receive the pulsating fluid through the opening. The dampening apparatus is attachable on a body of the pump such that the cylindrical container is in fluid communication with an fluid side of the pump to receive the pulsating fluid into the compression cavities, therefore dampening the pulsations via the compression cavities of the compression devices.

8 Claims, 9 Drawing Sheets

(56) References Cited

U.S. PATENT DOCUMENTS

| | | | | |
|---|---|---|---|---|
| 2011/0017332 | A1* | 1/2011 | Bartsch | B60T 8/4068 138/30 |
| 2011/0220419 | A1* | 9/2011 | Sjodin | B25D 9/145 175/99 |
| 2015/0338011 | A1* | 11/2015 | Van Haaren | F16L 55/053 138/30 |

* cited by examiner

DAMPENING APPARATUS

BACKGROUND

As known in the art, positive displacement pumps produce negative energies that severely age and damage the pump components as well as the system the pump is utilizing. In an effort to subdue these energies, gas-charged pulsation dampeners utilize the compressibility of gas to transfer the energy from the media being pumped. This is done through installing a rubber diaphragm inside a pulsation dampener and filling it with gas, specifically nitrogen gas. The inherent problem with this design is the failure of the diaphragm, which releases the compressible gas, leaving the pulsation dampener completely ineffective. As a result of this failure, a worker has to shut down the pump operations for maintenance of the pulsation dampener.

As discussed above, such gas-charged diaphragms have two major problems associated with their operations, the first problem is that the pre-charge needs to be adjusted to operational pressure and once diaphragm fails, the charge of gas is released and the pulsation dampener doesn't work effectively. Problems with pre-charge: if the pre-charge of gas is too high, the dampener will self-seal and doesn't work. If the pre-charge of gas is too low, the gas is compressed until it can no longer compress and without compression, it doesn't work. The second problem is with the diaphragm failure, where after the failure, all of the compressible gas escapes and the dampener doesn't work without compressible gas.

Hence, there is a long felt but unresolved need for a dampening apparatus which utilizes a non-pressurized mechanism to enable dampening of a pulsating fluid. Here, since the dampening apparatus is not retaining pressure, the life of the apparatus is enhanced, and there is no sudden loss of the compressible gas allowing for extreme operational times without shut down for maintenance and repair.

SUMMARY OF THE INVENTION

The dampening apparatus disclosed herein addresses the above mentioned needs for utilizing a non-pressurized mechanism to enable dampening of a pulsating fluid. The dampening apparatus configured to dampen pulsations caused by a pulsating fluid within a pump during a pumping process comprises a cylindrical container, and one or multiple compression devices positioned within the cylindrical container. The cylindrical container comprises multiple perforations on circumferential walls, and has an opening at one end. Each compression device comprises multiple compression cavities configured to receive the pulsating fluid through the opening. The dampening apparatus is attachable on a body of the pump such that the cylindrical container is in fluid communication with an fluid side of the pump to receive the pulsating fluid into the compression cavities, therefore dampening the pulsations via the compression cavities of the compression devices.

In an embodiment, the dampening apparatus is positionable inside a conventional dampener after replacing a diaphragm of the conventional dampener, wherein the pulsating fluid from the fluid side of the pump is received through the opening and into the compression cavities of the layers, therefore dampening the pulsations caused by the pulsating fluid. In an embodiment, each compression device comprises multiple gas infused segments arranged in a puzzle form to define compression cavities between each adjacent gas infused segment, where each gas infused segment further comprises a compression cavity within the gas infused segment. In an embodiment, the compression cavity defined between the adjacent gas infused segments is configured as a compression channel, and the compression cavity positioned on each gas infused segment is configured as a compression chamber.

In an embodiment, each compression device is arranged alternately on top of each other within the cylindrical container. In an embodiment, the gas infused segments defining the compression devices are made of foam material. In an embodiment, an inert gas is infused within the foam material. In an embodiment, the foam material comprises multiple microcells containing the inert gas, where each microcell is compressible from multiple sides.

DETAILED DESCRIPTION OF THE INVENTION

Figure 1A:
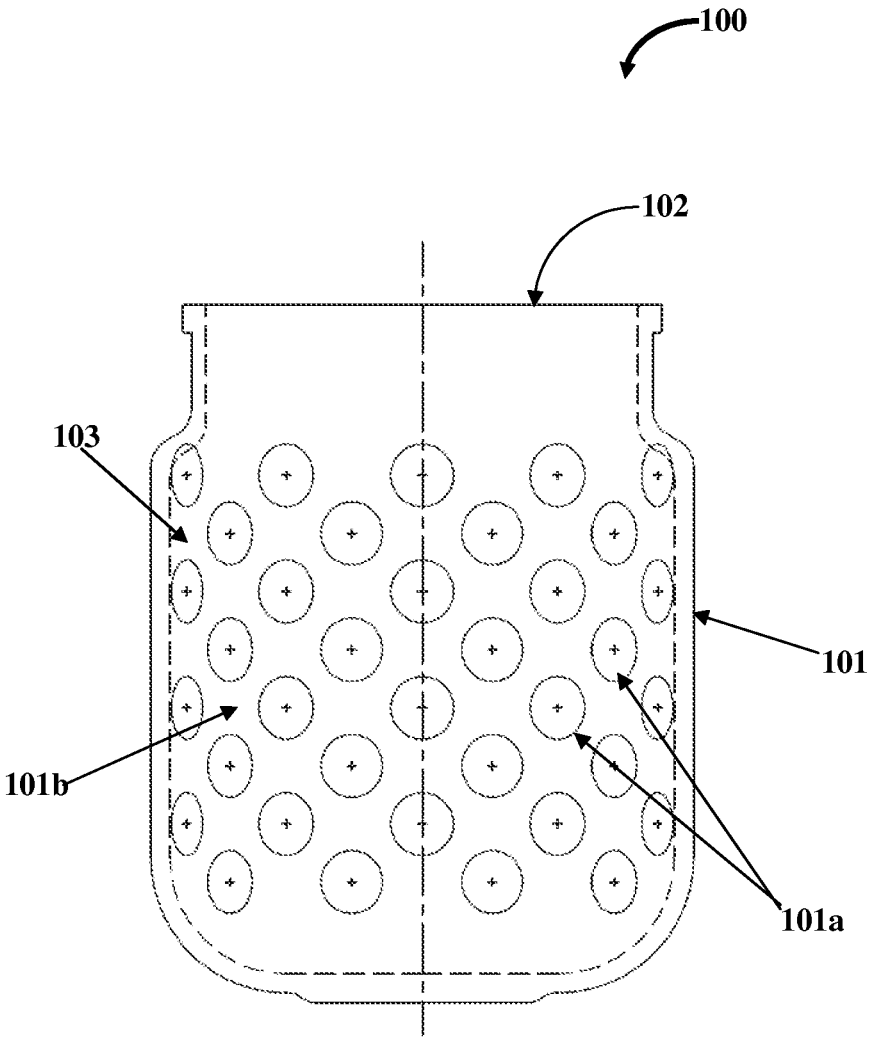
FIG. 1A exemplarily illustrates a front perspective view of the cylindrical container of the dampening apparatus.
Figure 1B:
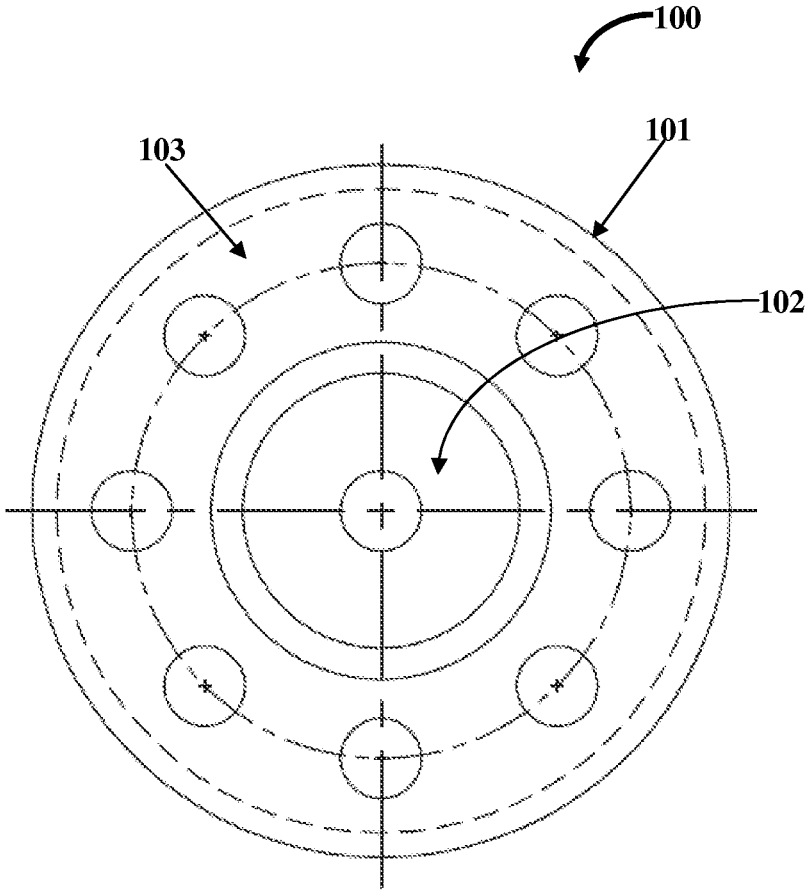
FIG. 1B exemplarily illustrates a top perspective view of the cylindrical container of the dampening apparatus.
Figure 1C:
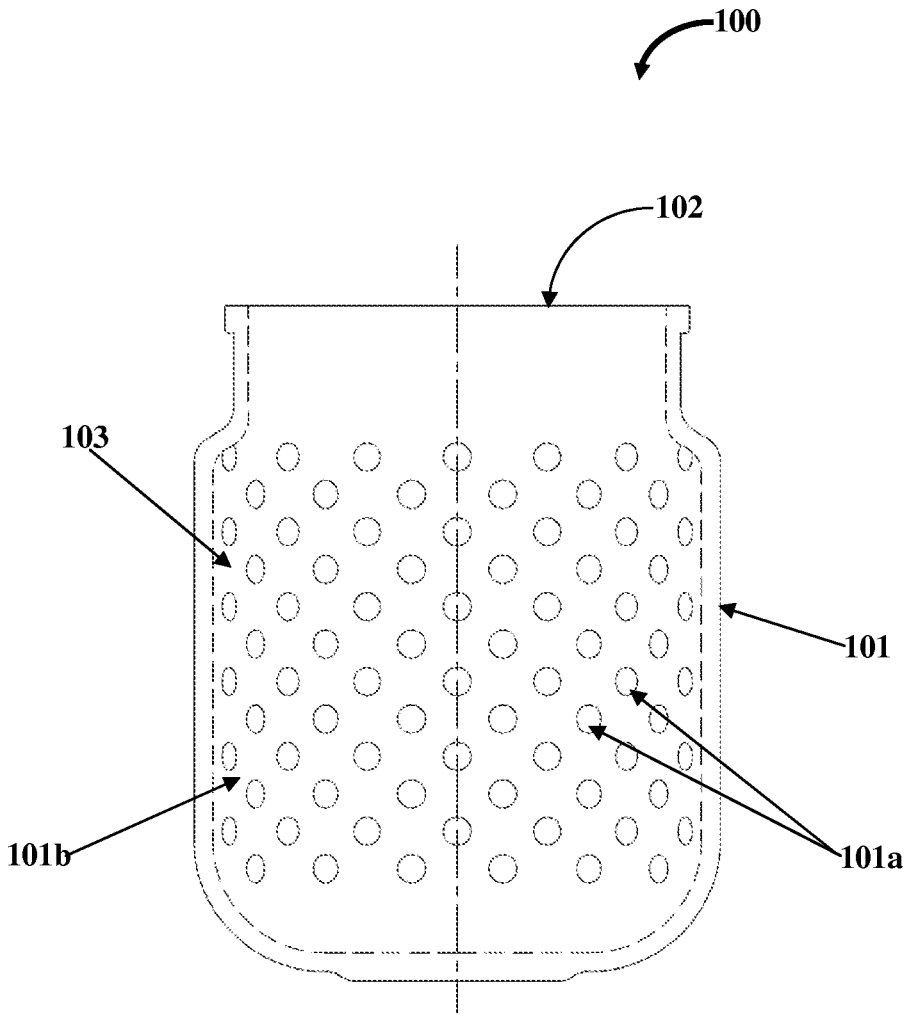
FIG. 1C exemplarily illustrates a front perspective view of an embodiment of the cylindrical container of the dampening apparatus.
Figure 1D:
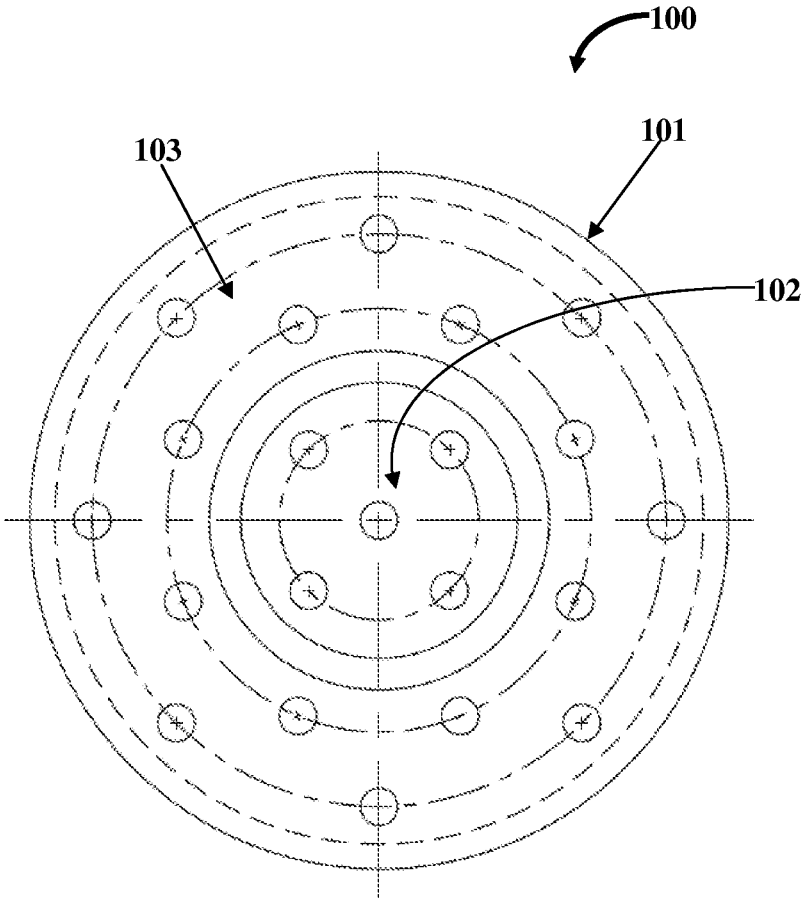
FIG. 1D exemplarily illustrates a top perspective view of the embodiment of the cylindrical container of the dampening apparatus in FIG. 1C.

FIG. 1A exemplarily illustrates a front perspective view of the cylindrical container 101 of the dampening apparatus 100, FIG. 1B exemplarily illustrates a top perspective view of the cylindrical container 101 of the dampening apparatus 100, FIG. 1C exemplarily illustrates a front perspective view of an embodiment of the cylindrical container 101 of the dampening apparatus 100, and FIG. 1D exemplarily illustrates a top perspective view of the embodiment of the cylindrical container 101 of the dampening apparatus 100 in FIG. 1C. As exemplarily illustrated in FIGS. 1A-1B and FIG. 2, the dampening apparatus 100 configured to dampen pulsations caused by a pulsating fluid, for example, air, within a pump during a pumping process comprises a cylindrical container 101, and one or multiple compression devices 103, for example, 1 layer as disclosed in FIGS. 1A-1B, positioned within the cylindrical container 101. The cylindrical container 101, for example, a suspension bag, comprises multiple perforations 101*a* on circumferential walls 101*b*, and has an opening 102 at one end. Each compression device 103 comprises multiple compression cavities 104 configured to receive the pulsating fluid through the opening 102 as exemplarily illustrated in FIGS. 2-3, and FIG. 4.

Figure 3:
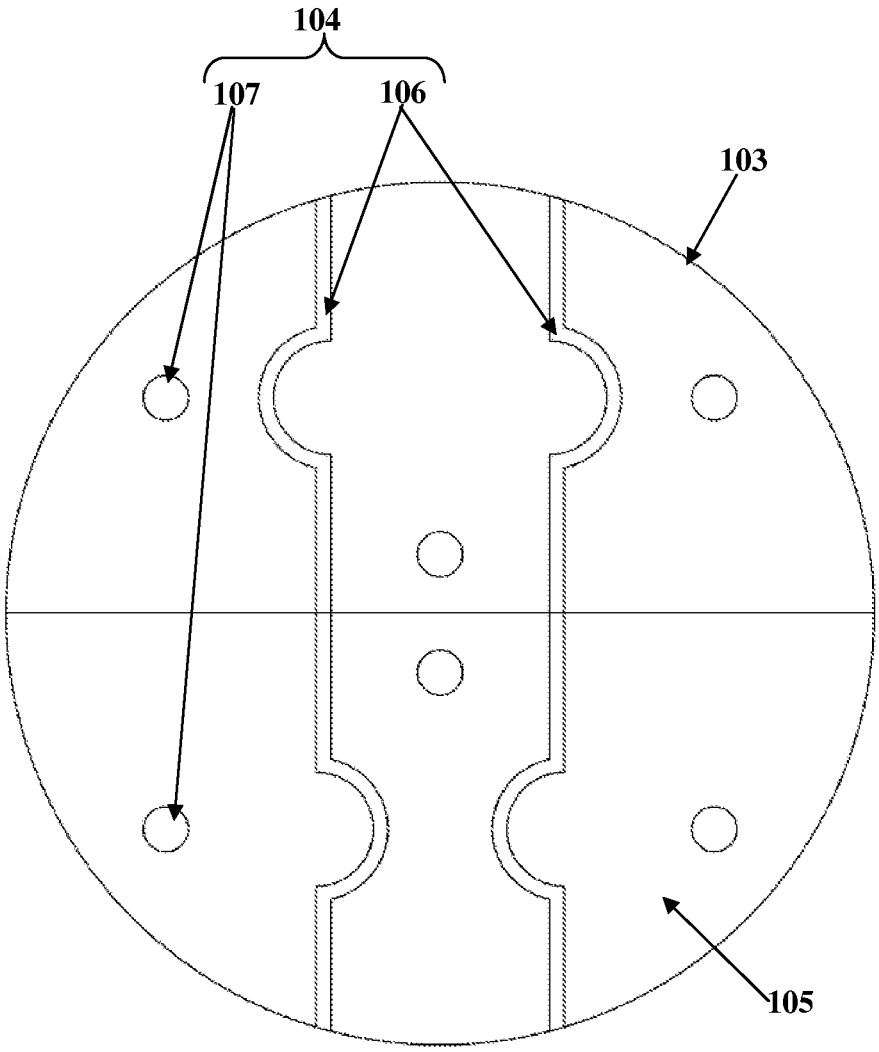
FIG. 3 exemplarily illustrates a top perspective view of one compression device of the dampening apparatus.
Figure 4:
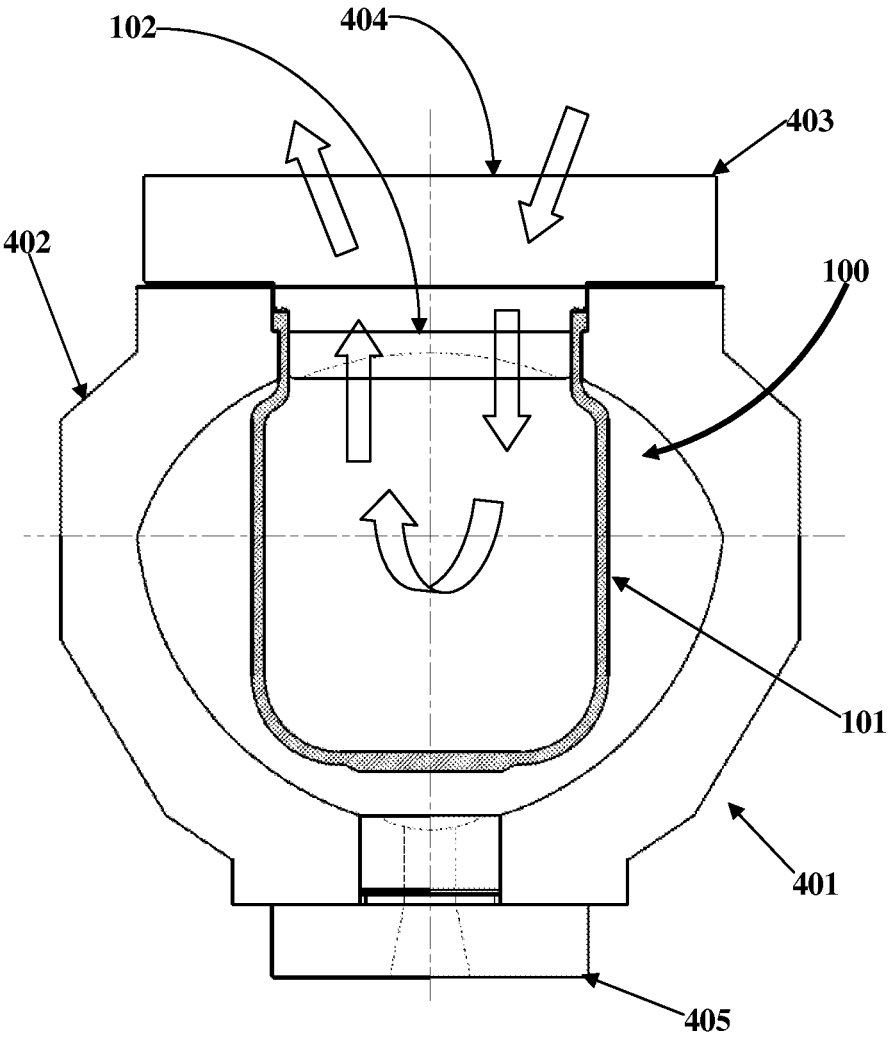
FIG. 4 exemplarily illustrates a front perspective view of the dampening apparatus positioned inside a conventional dampener of a pump, after replacing a damaged diaphragm of the conventional dampener.

The dampening apparatus 100 is attachable on a body of the pump such that the cylindrical container 101 is in fluid communication with an fluid side of the pump to receive the pulsating fluid into the compression cavities 104, therefore dampening the pulsations via the compression cavities 104 of the compression devices 103 as shown in FIG. 4. As shown in FIGS. 1A-1B and FIGS. 2-3, in an embodiment, the cylindrical container 101 comprises, for example, 8 perforations 101*a* and 1 perforations 101*a* at the center as described by FIG. 1B. As shown in FIGS. 1C-1D, the cylindrical container 101 comprises, for example, 8 perforations 101*a* in a first circle, second circle and third circle, and a perforations 101*a* at the center.

As further exemplarily illustrated in FIG. 4, in an embodiment, the dampening apparatus 100 is positioned inside a conventional dampener 401 after replacing a diaphragm of the conventional dampener 401, where the pulsating fluid from the fluid side of the pump is received through the opening 102 and into the compression cavities 104 of the layers, therefore dampening the pulsations caused by the pulsating fluid. That is, the dampening apparatus 100 replaces the pressure-retaining diaphragm of a conventional pulsation damper 401. The existing damaged pressure-retaining diaphragm is removed and the dampening apparatus 100 is installed in the previous position of the pressure-retaining diaphragm. The cover plate of the pulsation damper 401 is then closed to conceal the dampening apparatus 100 within the pulsation damper.

Figure 2:
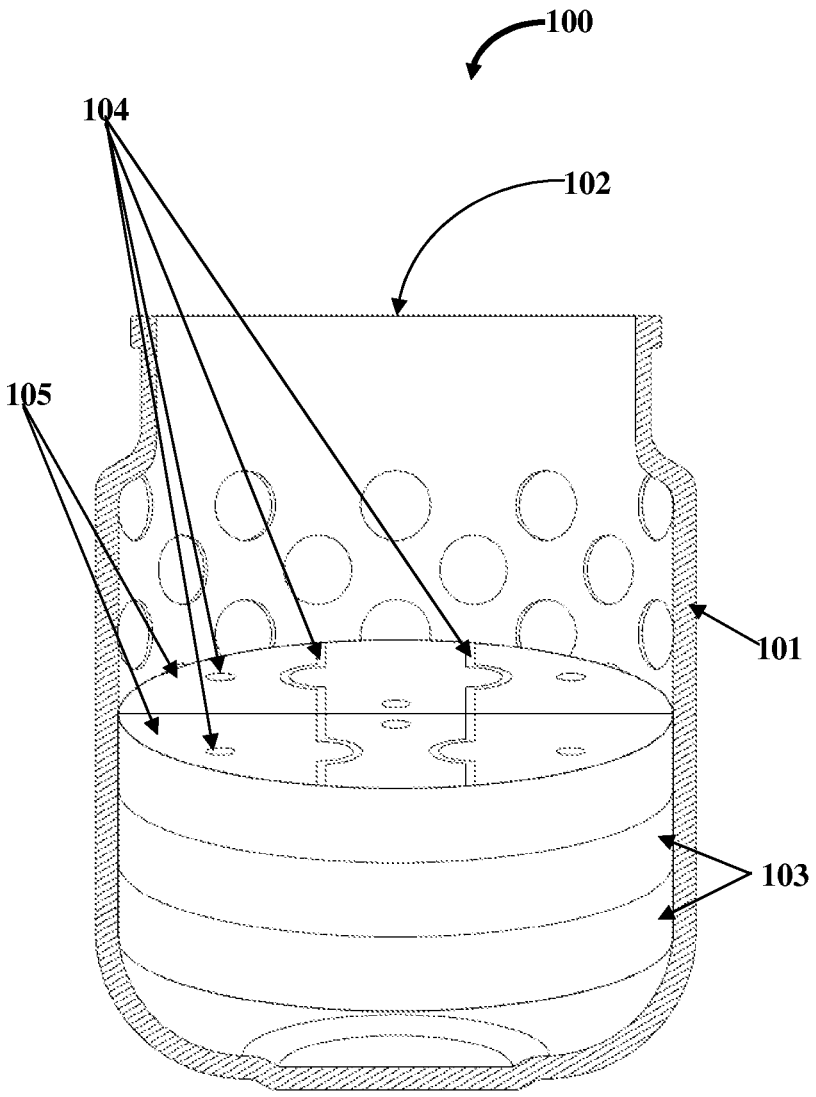
FIG. 2 exemplarily illustrates a partial sectional view of an embodiment of the dampening apparatus.

In an embodiment, each compression device 103 is arranged alternately on top of each other within the cylindrical container 101 as exemplarily illustrated in FIG. 2. In an embodiment, the compression devices 103 are made of, for example, foam material. In an embodiment, an inert gas, for example, nitrogen, is infused within the foam material. In an embodiment, the foam material comprises multiple microcells containing the inert gas, where each microcell is compressible from multiple sides.

FIG. 2 exemplarily illustrates a partial sectional view of an embodiment of the dampening apparatus 100. In an embodiment, each compression device 103 comprises multiple gas infused segments 105 arranged in a puzzle form to define compression cavities 104 between each adjacent gas infused segment 105, where each gas infused segment 105 further comprises a compression cavity 104 within the gas infused segment 105. In an embodiment, each compression device 103 is arranged alternately on top of each other within the cylindrical container 101. In an embodiment, the gas infused segments 105 defining the compression devices 103 are made of, for example, foam material such as rubber foam. In an embodiment, an inert gas is infused within the foam material.

In an embodiment, the foam material comprises multiple microcells containing the inert gas, where each microcell is compressible from multiple sides. The dampening apparatus 100 replaces the pressure-retaining diaphragm of a conventional pulsation dampener 401 as shown in FIG. 4. The dampening apparatus 100 comprises the cylindrical container 101 along with the compression devices 103. The compression devices 103 works together with gas-infused, closed-cell rubber foam pieces to mitigate the negative energies produced from the pump. Since there is no gas-retaining diaphragm and the gas is contained in the cellular foam, there is no failure from the sudden loss of gas pressure in the diaphragm allowing for continuous use without maintenance for extremely long periods of operation of the pump.

FIG. 3 exemplarily illustrates a top perspective view of the compression device 103 of the dampening apparatus 100. As exemplarily illustrated in FIG. 2, each gas infused segment 105 comprises compression cavities 104 defined between adjacent gas infused segments 105, and compression cavities 104 positioned within each gas infused segment 105. In an embodiment, the compression cavity 104 defined between the adjacent gas infused segments 105 is configured as a compression channel 106, and the compression cavity 104 positioned on each gas infused segment 105 is configured as a compression chamber 107. The dampening apparatus 100 is molded out of, for example, nitrile butadiene rubber or hydrogenated nitrile butadiene rubber. The gas infused segment 105 or the closed cell foam rubber is molded into specific shape depending on the layer position in the dampening apparatus 100. The dampening apparatus 100 can only be installed one way as mentioned later in this description. The layers of cellular foam is designed and formed to fit into the dampening apparatus 100 in designated layers. Following the recommended layer format is imperative to the performance of the dampening apparatus 100 as a whole.

As for construction, each compression device 103 is positioned alternately on top of each other within the cylindrical container 101, for example, the three layers as shown in FIG. 2, are positioned one after another on top of each other. The positioning is performed in a manner that each compression chamber 107 and compression channel 106 is clear to communicate in fluid communication. As shown in FIG. 4, the assembled dampening apparatus 100 is positioned within the casing of an existing pulsation dampener 401 of a pump after replacing the damaged diaphragm inside the existing pulsation dampener 401. The dampening apparatus 100 is then sealed by closing the cover plate of the pulsation dampener 401 and therefore the dampening apparatus 100 is ready for operation.

As exemplarily illustrated in FIGS. 2-4, the dampening apparatus 100 allows the pulsating fluid to penetrate into the interior of the dampening apparatus 100 through the opening 102 of the cylindrical container 101 where the gas infused segments 105 or the cellular foam pieces are stored. The cellular foam pieces are designated to be put together in the form of puzzle pieces. This allows the formation of external compression channels 106 in each layer of cellular foam. There are also internal compression chambers 107 present in each gas infused segment 105 that will provide separation between layers. The compression channels 106 and the compression chambers 107 are offset from row to row allowing for the pulsating fluid to completely envelop the cellular foam pieces. Since the dampening apparatus 100 allows for penetration of the pulsating fluid inside the cylindrical container 101, the pulsating fluid would then travel up the external compression channels 106 and the internal compression chambers 107 layer by layer until the entire cylindrical container 101 is filled. The external compression channels 106 is configured to allow compression of each cellular foam piece on one hundred percent of the vertical exterior walls.

As exemplarily illustrated in FIGS. 2-4, the internal compression chambers 107 would allow for the pulsating fluid to form a separation layer in-between each layer of cellular foam as well as an internal vertical compression chamber 107 and two horizontal compression areas, the top and bottom of each of the compression devices 103 made of foam. Since the compression channels 106 and the compression chambers 107 are offset, the pulsating fluid is forced to travel indirectly through the dampening apparatus 100 causing an energy baffling effect. This baffling effect dampens the effect of pulsations caused by the pulsating fluid.

FIG. 4 exemplarily illustrates a front perspective view of the dampening apparatus 100 positioned inside a conventional dampener 401 of a pump, after replacing a damaged diaphragm of the conventional dampener 401, for example, a positive displacement pump such as a diaphragm pump, to dampen the pulsations caused by the pulsating fluid of the pump during a pumping process. The dampening apparatus 100 is fixedly attached to a body of the pump such that the opening 102 of the cylindrical container 101 of the dampening apparatus 100 is configured to receive the pulsating fluid within the compression cavities 104 as shown in FIG. 2. Here, the dampening apparatus 100 positioned inside a conventional dampener 401 after replacing a damaged diaphragm of the conventional dampener 401. The dampening apparatus 100 is positioned within a casing 402 of the conventional dampener 401, and between an upper seal cap 403 with inlet 404 for the pumping media and a lower seal cap 405.

The pulsation of the pulsating fluid, for example, air, occurs when a pumped media such as water is pumped through an inlet and outlet of the diaphragm pump, where the diaphragm of the pump is forced upward and the air on the fluid side of the pump is forced on to the body of the pump. As the air enters through inlet 404 of the conventional dampener 401 and through the opening 102 of the dampening apparatus 100, the inert gas within the foam material of the compression devices 103 interacts with the air received within the compression cavities 104 to establish an energy baffling effect, as exemplarily illustrated in FIGS. 1A-2 and as shown by the arrows in FIG. 4, thereby dampening the effect of pulsations developed on the fluid side of the pump.

Figure 5A:
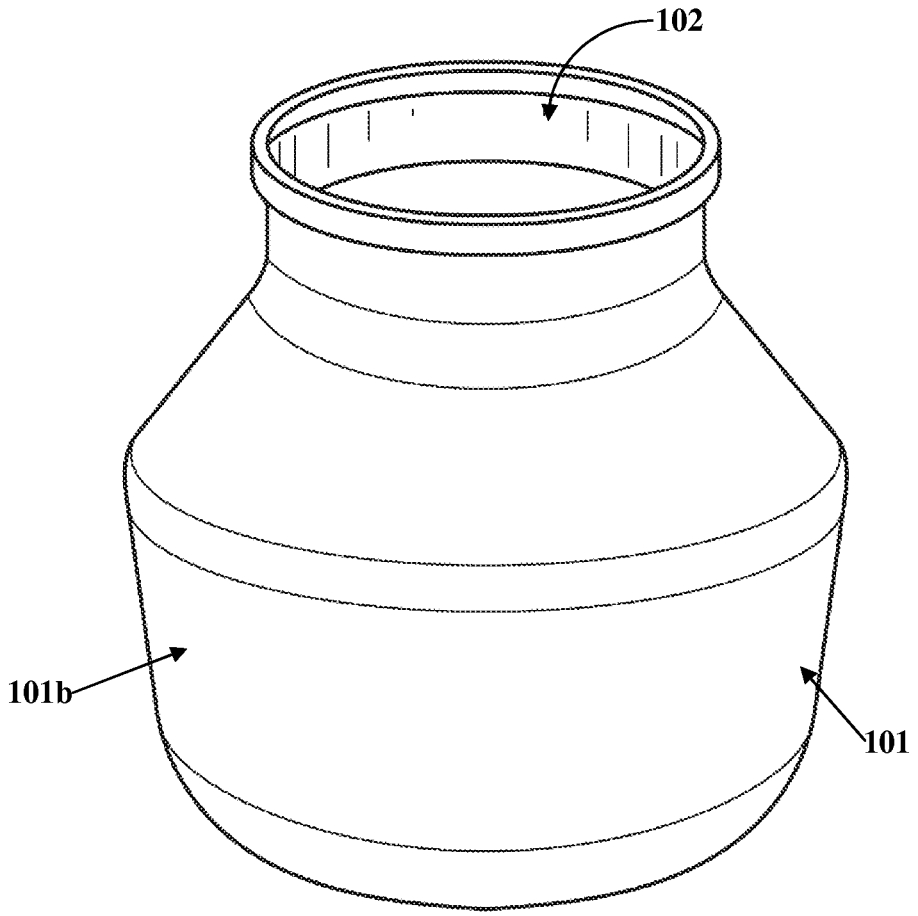
FIG. 5A exemplarily illustrates a front perspective view of an embodiment of the cylindrical container of the dampening apparatus.
Figure 5B:
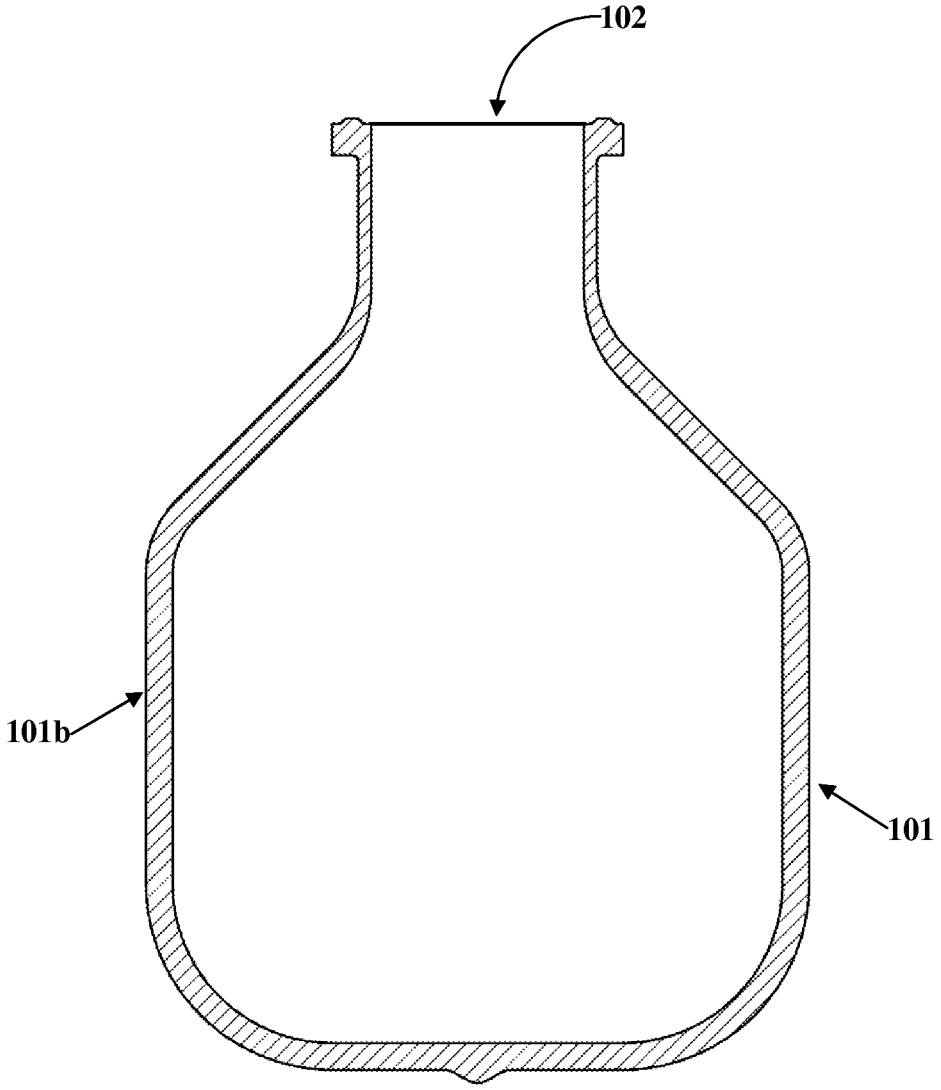
FIG. 5B exemplarily illustrates a sectional view of the embodiment of the cylindrical container in FIG. 5A.

FIG. 5A exemplarily illustrates a front perspective view of an embodiment of the cylindrical container 101 of the dampening apparatus 100, and FIG. 5B exemplarily illustrates a sectional view of the embodiment of the cylindrical container 101 in FIG. 5A. In an embodiment, the cylindrical container 101 is configured free of multiple perforations 101*a* on the circumferential walls 101*b*, and comprises an opening 102 at one end. The compression devices 103 are positioned inside the cylindrical container, and each compression device 103 comprises multiple compression cavities 104 configured to receive the pulsating fluid through the opening 102.

The foregoing examples have been provided merely for the purpose of explanation and are in no way to be construed as limiting of the present concept disclosed herein. While the concept has been described with reference to various embodiments, it is understood that the words, which have been used herein, are words of description and illustration, rather than words of limitation. Further, although the concept has been described herein with reference to particular means, materials, and embodiments, the concept is not intended to be limited to the particulars disclosed herein; rather, the concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the concept in its aspects.

I claim:

1. A dampening apparatus configured to dampen pulsations caused by a pulsating fluid within a pump during a pumping process, the dampening apparatus comprising:

a flexible cylindrical container comprising a first plurality of perforations formed in a first substantial circle and a second plurality of perforations formed in a second substantial circle on circumferential walls, and an opening at one end; and one or a plurality of compression devices positioned within the cylindrical container, each compression device comprising a plurality of compression cavities configured to receive the pulsating fluid through the opening, wherein the dampening apparatus is attachable on a body of the pump such that the cylindrical container is in fluid communication with a fluid side of the pump to receive the pulsating fluid into the compression cavities, therefore dampening the pulsations via the compression cavities of the compression devices.

2. The dampening apparatus of claim 1, wherein the dampening apparatus is positioned inside a dampener.

3. The dampening apparatus of claim 1, wherein each compression device comprises a plurality of gas infused segments arranged in a puzzle form to define compression cavities between each adjacent gas infused segment, wherein each gas infused segment further comprises a compression cavity within the gas infused segment.

4. The dampening apparatus of claim 3, wherein the compression cavity defined between the adjacent gas infused segments is configured as a compression channel, and the compression cavity positioned on each gas infused segment is configured as a compression chamber.

5. The dampening apparatus of claim 3, wherein each compression device is arranged alternately on top of each other within the cylindrical container.

6. The dampening apparatus of claim 1, wherein the gas infused segments defining the compression devices are made of foam material.

7. The dampening apparatus of claim 6, wherein an inert gas is infused within the foam material.

8. The dampening apparatus of claim 6, wherein the foam material comprises a plurality of microcells containing the inert gas, wherein each microcell is compressible from a plurality of sides.

* * * * *